US007735606B1

(12) United States Patent
Norton

(10) Patent No.: US 7,735,606 B1
(45) Date of Patent: Jun. 15, 2010

(54) SCAFFOLD SUPPORT PLATFORM

(76) Inventor: William L. Norton, 8690 Yoder Rd., Wadsworth, OH (US) 44281

( * ) Notice: Subject to any disclaimer, the term of this patent is extended or adjusted under 35 U.S.C. 154(b) by 915 days.

(21) Appl. No.: 11/464,418

(22) Filed: Aug. 14, 2006

(51) Int. Cl.
*E04G 1/15* (2006.01)

(52) U.S. Cl. ..... 182/186.9; 182/186.6; 182/186.7; 182/186.8; 182/222

(58) Field of Classification Search ..... 182/82, 182/130, 131, 186.6–186.9, 222; 248/210, 248/219.1, 229.1, 235, 236, 238; 108/152
See application file for complete search history.

(56) References Cited

U.S. PATENT DOCUMENTS

| | | | | | |
|---|---|---|---|---|---|
| 474,406 | A | * | 5/1892 | Ramsey | 182/62 |
| 488,247 | A | * | 12/1892 | Loebs | 108/151 |
| 656,298 | A | * | 8/1900 | O'Brien | 182/186.9 |
| 1,957,184 | A | * | 5/1934 | Smith | 248/236 |
| 2,125,830 | A | * | 8/1938 | Uecker et al. | 248/235 |
| 2,261,907 | A | * | 11/1941 | Uecker et al. | 248/235 |
| 2,392,347 | A | * | 1/1946 | Walker | 248/238 |
| 2,413,297 | A | * | 12/1946 | Deckert | 414/22.51 |
| 2,897,013 | A | * | 7/1959 | Delp | 52/645 |
| 2,904,126 | A | * | 9/1959 | Meng et al. | 182/103 |
| 2,984,446 | A | * | 5/1961 | Richter | 248/238 |
| 3,116,808 | A | * | 1/1964 | Riley | 182/129 |
| 3,134,567 | A | * | 5/1964 | Shoemaker | 248/243 |
| 3,245,495 | A | * | 4/1966 | Wells, Jr. | 182/152 |
| 3,270,997 | A | * | 9/1966 | Gethmann | 248/235 |
| 3,493,208 | A | * | 2/1970 | Sato | 248/235 |
| 3,604,687 | A | * | 9/1971 | Moore | 256/65.04 |
| 3,822,847 | A | * | 7/1974 | Emmons | 248/210 |
| 3,856,244 | A | * | 12/1974 | Menshen | 248/67.5 |
| 3,870,124 | A | * | 3/1975 | Howard | 182/178.5 |
| 4,372,425 | A | * | 2/1983 | Murphy | 182/186.9 |
| 4,641,728 | A | * | 2/1987 | McCabe | 182/146 |
| 4,821,844 | A | * | 4/1989 | Huffman et al. | 182/186.9 |
| 5,203,428 | A | | 4/1993 | Beeche | |
| 5,588,500 | A | | 12/1996 | Yohahara | |
| 5,810,114 | A | | 9/1998 | White | |
| 5,931,423 | A | * | 8/1999 | Heideloff | 248/74.4 |
| 6,026,932 | A | * | 2/2000 | Comp | 182/150 |
| 6,131,698 | A | | 10/2000 | Reyland | |
| 6,422,345 | B1 | | 7/2002 | Schworer | |
| 6,554,102 | B2 | | 4/2003 | Schworer | |
| 6,616,399 | B1 | * | 9/2003 | Stevens | 414/740 |
| 6,732,836 | B2 | | 5/2004 | Tatsuo | |
| 7,500,645 | B1 | * | 3/2009 | McCubbins | 248/210 |
| 2003/0168560 | A1 | * | 9/2003 | Chipka | 248/218.4 |
| 2004/0163889 | A1 | | 8/2004 | Wallther | |
| 2005/0061582 | A1 | | 3/2005 | Karanouh | |
| 2006/0000673 | A1 | | 1/2006 | Wallther | |

* cited by examiner

*Primary Examiner*—Katherine W Mitchell
*Assistant Examiner*—Colleen M Quinn
(74) *Attorney, Agent, or Firm*—Nancy L. Reeves; Walker & Jocke

(57) ABSTRACT

A scaffolding support platform for use with a scaffolding system including a fabricated end frame including a floor having a flat surface adapted to support a worker and a support frame including a base for supporting the floor, a plurality of anchors to releasably attach the support frame to a fabricated end frame and a plurality of support members extending between the base and at least one anchor.

5 Claims, 20 Drawing Sheets

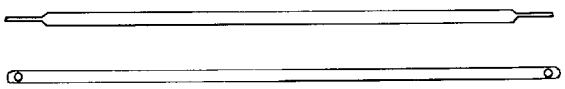
Fig. 20(b)
Fig. 20(c)
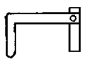
Fig. 20(d)
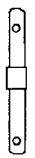
Fig. 20(e)
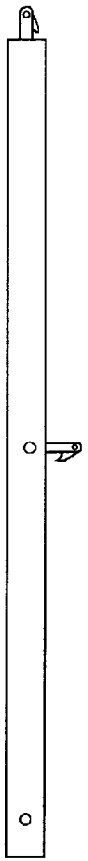
Fig. 20(a)

SCAFFOLD SUPPORT PLATFORM

TECHNICAL FIELD

This invention relates generally to scaffolding. Specifically, this invention relates to a support platform which may be used with traditional scaffolding in order to decrease the risks associated with lifting or lowering a plank walkway from one level to another.

BACKGROUND ART

Scaffolding, particularly fabricated frame scaffolding, often uses a pair of planks supported by side brackets hung off of the scaffolding frame which, together with successive and overlapping pairs of planks, form a walkway. Fabricated frame scaffolding systems may also be known as a welded tube scaffold systems, or fabricated tubular frame scaffold systems. When work is completed at one level, workers often need to raise or lower the walkway. This is done by raising or lowering the planks that form the walkway.

The traditional means of raising planks is by having one worker stand on the end of the next pair of planks in the walkway and lift the planks to be raised. A second worker, standing on the scaffolding, raises a side bracket near the middle of the planks, and attaches it to the scaffolding at approximately half the distance between the current height of the walkway and the desired height. The first worker then lowers the end of the planks to be raised to the level of the current walkway, using the side bracket as a fulcrum. This forces the far end of the planks to the new level. The second worker fixes a side bracket at the height of second end of the planks. The first worker raises the end of the planks to the same height as the new side bracket, while the second worker moves the middle side bracket to the desired height. Each successive pair of planks is raised in this manner until the last pair of planks is reached.

When the worker reaches the last pair of planks, because there is no next pair of planks on which to stand, the first worker must use the end of the scaffolding as a ladder and struggle to maintain his position while lifting and moving a pair of planks which typically weighs 120 lbs. This manner of raising scaffolding is extremely hazardous, and too many workers are injured when they are unable to both maintain their position and maneuver the planks.

Thus, there is a need for a support platform on which a worker can stand while raising the last pair of planks in the walkway. There is further a need for this place to stand to be easy to move and to provide protection against falls.

DISCLOSURE OF INVENTION

It is an object of an exemplary form of the present invention to provide a support platform on which to stand while moving the end planks in a scaffolding walkway.

It is a further object of an exemplary form of the present invention to provide such a support platform which is compatible with commercial scaffolding.

It is a further object of an exemplary form of the present invention to provide such a support platform which is easily moveable from one height to another.

It is a further object of an exemplary form of the present invention to provide such a support platform which is partially surrounded by guard rails which form, with the scaffolding guardrails, an unbroken safety rail around the work area.

It is a further object of an exemplary form of the present invention to provide such a support platform which includes other safety features, such as a slip resistant surface.

Further objects of an exemplary form of the present invention will be made apparent in the following Best Modes for Carrying Out Invention and the appended claims.

The foregoing objects are accomplished in an exemplary embodiment of the invention by a support platform held up by a support frame that is braced and supported by a first, approximately vertical, support member and a plurality of additional support members extending from the support frame to the first support member, which apparatus can be removably attached to standard fabricated frame scaffolding.

BRIEF DESCRIPTION OF DRAWINGS

FIGS. 20(*a*) through 20(*e*) are views of exemplary brackets used to form a guard rail, respectively a guard rail post, side and top views of a guard rail, a safety or lock pin, and a scaffolding pin.

BEST MODES FOR CARRYING OUT INVENTION

Figure 1:
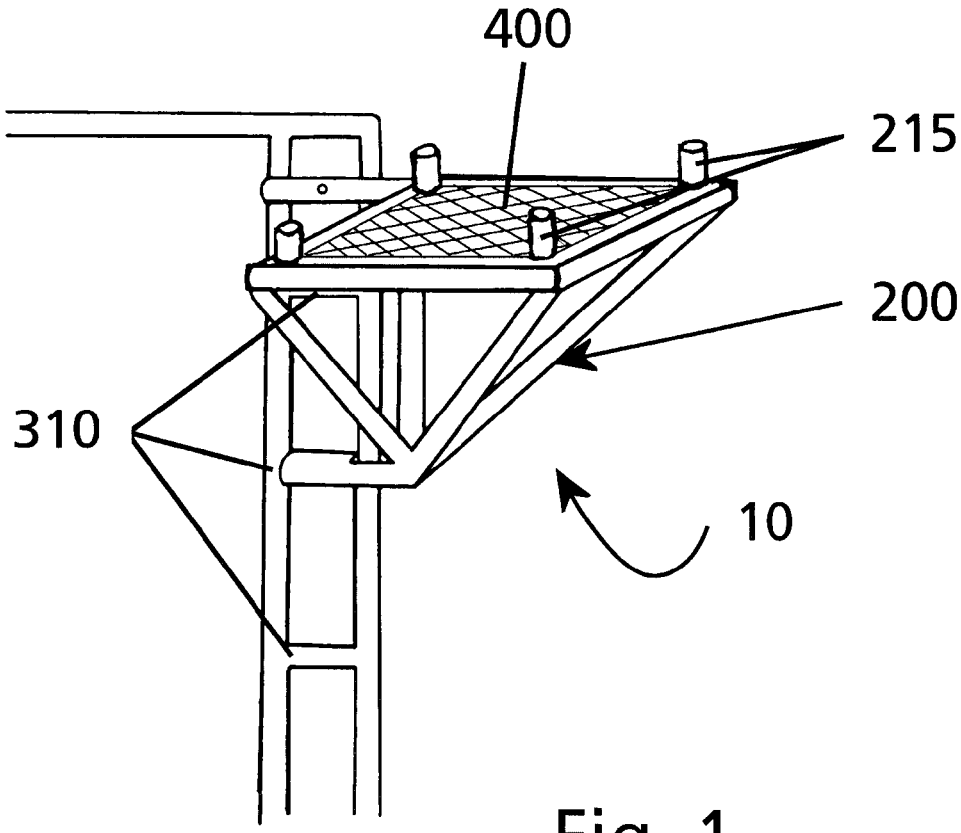
FIG. 1 is a perspective view of an exemplary embodiment of a support platform

Referring now to the drawings, and in particular to FIG. 1, there is shown therein an exemplary embodiment of a support platform 10. An exemplary embodiment of a support platform 10 may be comprised of a support frame 200, illustrated in more detail in FIG. 2 and a floor 400, illustrated in more detail in FIG. 9.

Figure 2:
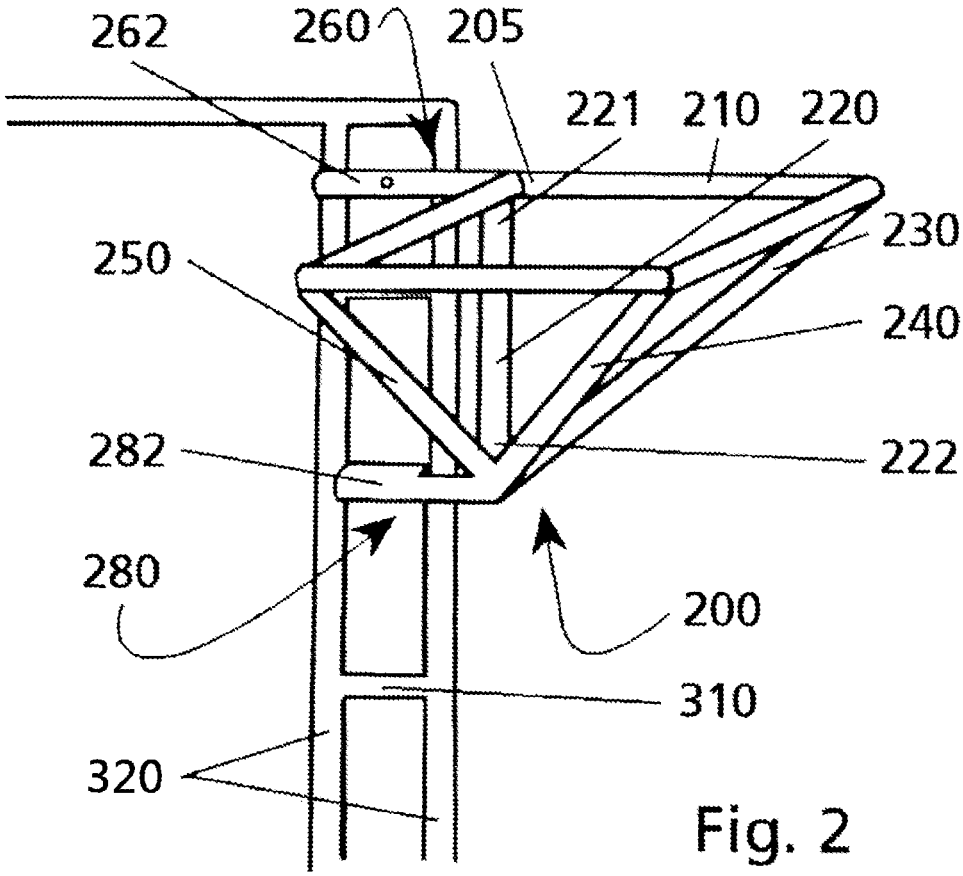
FIG. 2 is a perspective view of an exemplary embodiment of a support frame for holding up a support platform.

An exemplary support frame 200 may be comprised of an open, generally rectangular base 210 on which floor 400 may rest. As illustrated in FIG. 2, the base 210 may be supported by a first support member 220 extending generally perpendicularly downward from one corner 205 of the base 210 to an anchor 280, discussed in more detail below. In an exemplary embodiment, the first support member 220 may be in an approximately vertical orientation when the support platform 10 is being used for support. Because of this, first support member 220 may sometimes be referred to as a vertical support member 220. The base 210 may be further supported by second, fourth, and third support members 230, 250, 240 extending respectively from each of the two corners adjacent to corner 205 and from the corner diagonally opposite corner 205 to the anchor 280 at the bottom of the first support member 220. In an exemplary embodiment with a rectangular support frame 200, corner 205 may also be referred to as the first corner 205, the corner diagonally opposite first corner 205 may also be referred to as the third corner, the corners adjacent the first corner may also be referred to as the second and fourth corners. In an exemplary embodiment having a different geometric shape, first corner 205 will be adjacent the first support member 220 and additional corners, clockwise when viewed from above, may be referred to as the second through nth corners.

In an exemplary embodiment, the support frame 200 may be made of the same type of metal tubing as the scaffolding frame 300 to which it is to be attached. In other embodiments, the support frame 200 may be composed of different material, such as a different metal, or other material which is currently known or which may become known, that is sturdy enough support one or more workers and to withstand the rigors of repeated assembly and disassembly. Similarly, in an exemplary embodiment illustrated, the shape of the members comprising the base 210, first support member 220, and additional support members 230, 240, 250 is tubular. In other embodiments, the base 210, first support member 220, and additional support members 230, 240, 250 may be formed with a different shape, so long as the structural shape of the members creates a structure that is sufficiently strong, when assembled as described in an exemplary fashion herein, to support floor 400 and the worker or workers standing on it, and to withstand the rigors of repeated assembly and disassembly. Other exemplary embodiments include brace members extending between support members 220, 230, 240, and 250, diagonal or cross members across the base 210, or support members 230, 240, and 250 connecting with vertical support member 220 at a location other than the second end 222, or curved support members.

Although in the exemplary embodiment illustrated in FIG. 2 base 210 is rectangular, in other embodiments the base 210 may have any other shape, such as triangular or trapezoidal, which is suitable for holding up a floor 400 with a first support member 220 to which anchors, described below, may be attached, and a plurality of (n−1) additional support members 230, 240, 2(n+1)0, which serve as braces.

Base 210 may further include scaffolding pins 215, as illustrated in FIG. 1, on its upper surface at the corners, or along edges as may be needed to provide adequate support for a guard rail system.

As noted above, support frame 200 includes anchors. The exemplary embodiment illustrated herein includes anchors 260, 280 to attach the support frame 200 to the scaffold end frame 300. In the exemplary embodiment illustrated in FIG. 2 a first anchor 260 may be comprised of a horizontal extension 262 from a first end 221 of the first support member 220 in a plane parallel to the scaffold end frame 300, which plane is further defined by the first support member 220 and second support member 230

Figure 6:
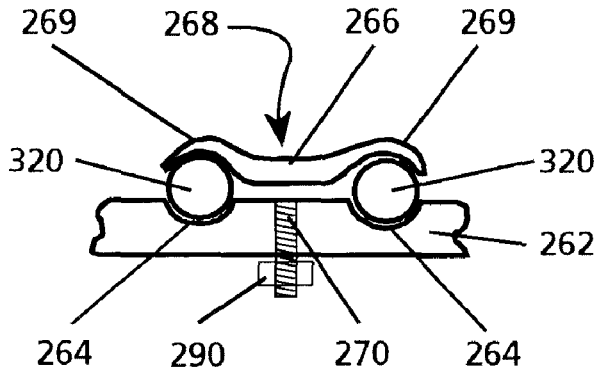
FIG. 6 is a top view of an exemplary clamp for fixing a support platform to scaffolding.

As may be seen more clearly in FIG. 6, extension 262 may include detents 264 comprising vertical channels positioned to mate with two vertical tubes 320 which generally form part of the scaffold end frame 300 of a fabricated frame scaffolding system. Anchor 260 may further include a clamp member 268 comprised of a plate 266 having a "C" shaped clamping member 269 on each end of the plate 266 adapted to mate with the two vertical tubes 320 on the opposite side of the vertical tubes 320 from the extension 262. Clamp 268 may be fastened tightly together by a central bolt and nut 270, 290 to clamp the top portion of the support frame 200 to the scaffolding 300.

A second exemplary anchor 280 comprises an extension 282 perpendicular to the first support member 220, extending from the point, the second end 222 of first support member 220, at which the first support member 220 meets the diagonal support members 230, 240, 250 in the exemplary embodiment illustrated in FIG. 2. As illustrated in the exemplary embodiment in FIG. 2, when the support frame 200 is attached to the scaffold end frame, second support member 230 is in the plane parallel to the scaffold end frame 300 and fourth support member 250 is in the plane perpendicular to the scaffold end frame 300. The extension 282 may be parallel to and in the same plane as extension 262.

Figure 7:
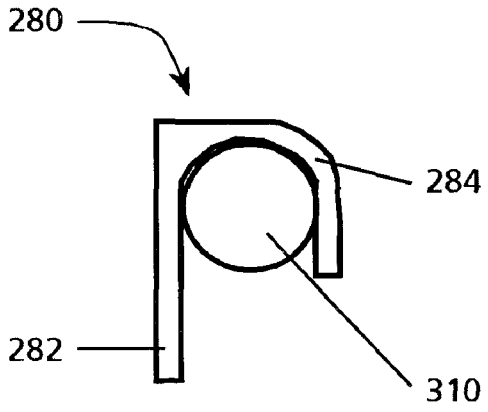
FIG. 7 is a side view of an exemplary lower attachment for fixing a support platform to scaffolding.
Figure 8:
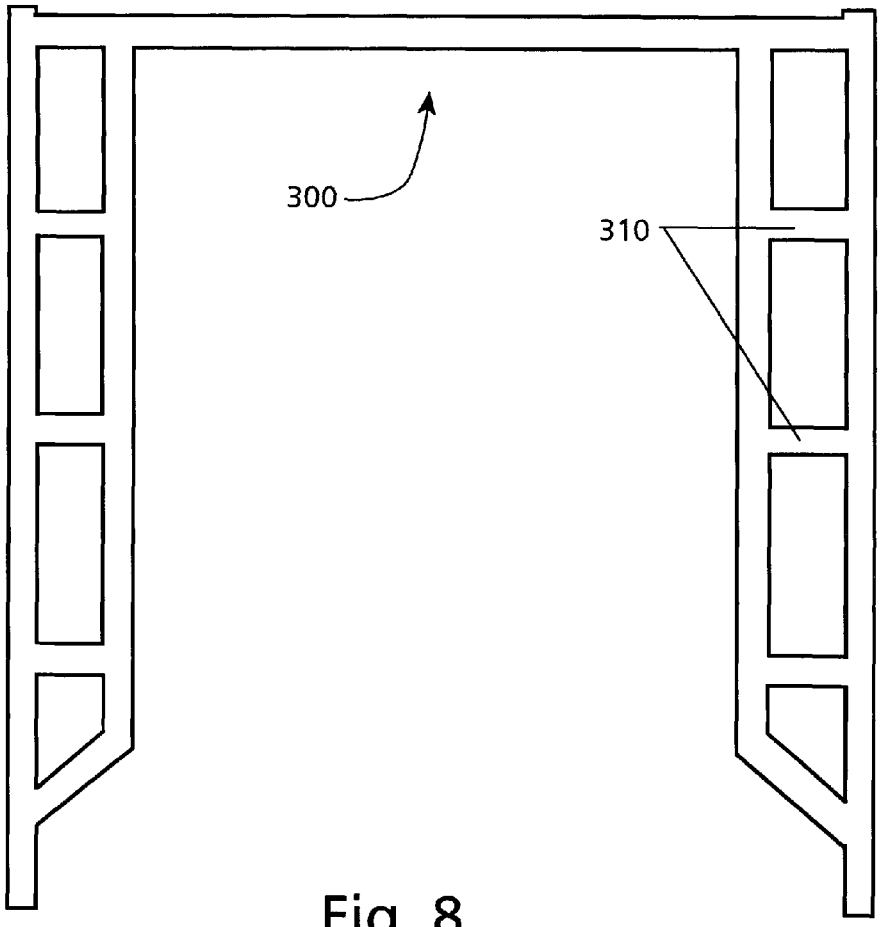
FIG. 8 is a front view of the scaffolding frame.

In an exemplary embodiment, extension 282 may include hook 284, as can be seen more clearly in FIG. 7. The exemplary embodiment of hook 284 is comprised of a broad plate bent in a rounded right angle, extending from the top of extension 282 into base 210 and bending so that hook 284 rests on a rung 310 between the two vertical tubes 320, with hook 284 opening downward. A second exemplary embodiment is illustrated in FIG. 2, in which extension 282 is roughly tubular, and open on the back side to create a hook 284.

Figure 3:
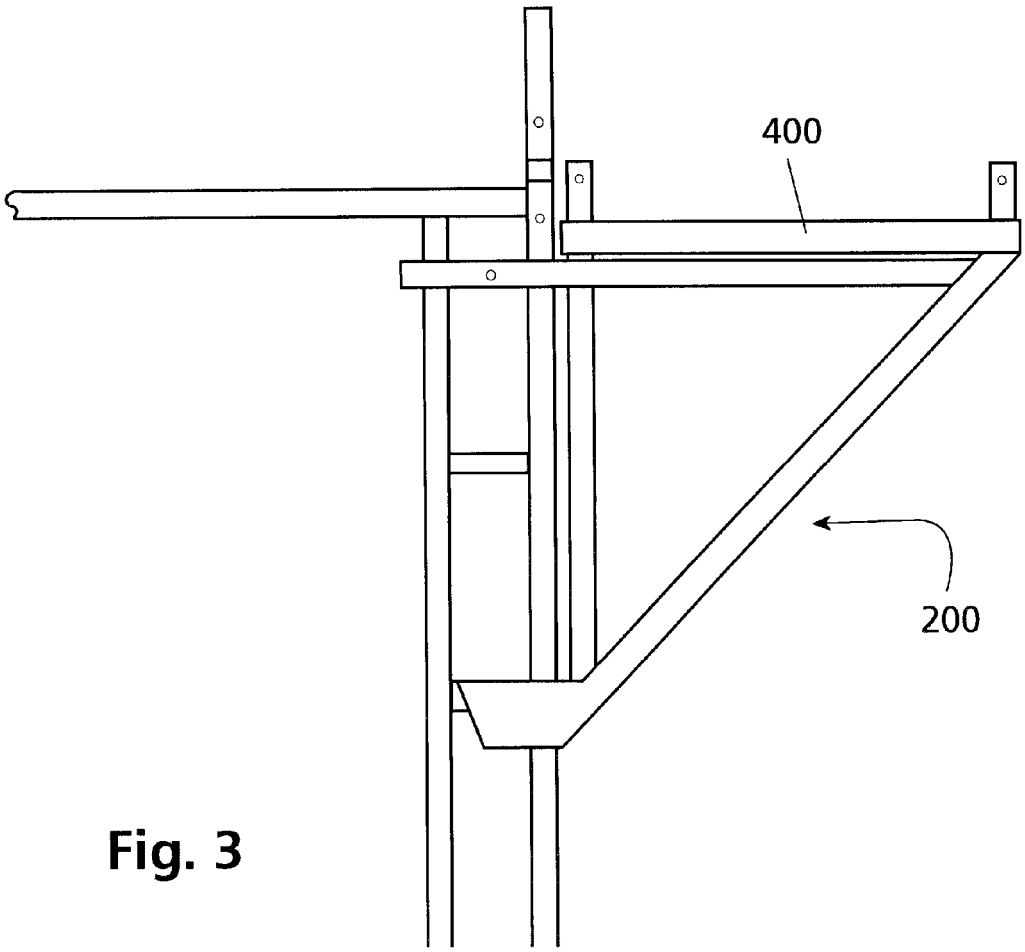
FIG. 3 is a side view of an exemplary embodiment of a support frame for holding up a support platform, from the perspective of the end of the scaffolding frame.

Although in this exemplary embodiment a support frame 210 includes two anchors 260, 280 in other embodiments it may contain more. For example, a second anchor may be added to correspond to an intermediate rung, as illustrated in FIG. 3. An additional anchor similar to either anchor 260 or 280 may be added at an intermediate position along the first support. Either anchor, or additional anchors if any exist, may include a portion which mates with one or both vertical tubes such as, for example, adding a vertical extension having a hook to the lower extension to provide support along the rung and along the vertical tube closest to the support frame 200.

In addition, in this exemplary embodiment, the two anchors are described as having different and distinct forms. In other embodiments, both anchors may be of the same type. The two embodiments of anchors have been described herein are intended to be exemplary rather than limiting. For example, anchors could comprise standard C-clamps affixed to an extension, latches, tension buckles, or other similar grasping mechanisms. Any anchor known or which may become known to those skilled in the art which provides vertical support and horizontal and vertical stability may be substituted for one or both of the anchors described herein.

Figure 9:
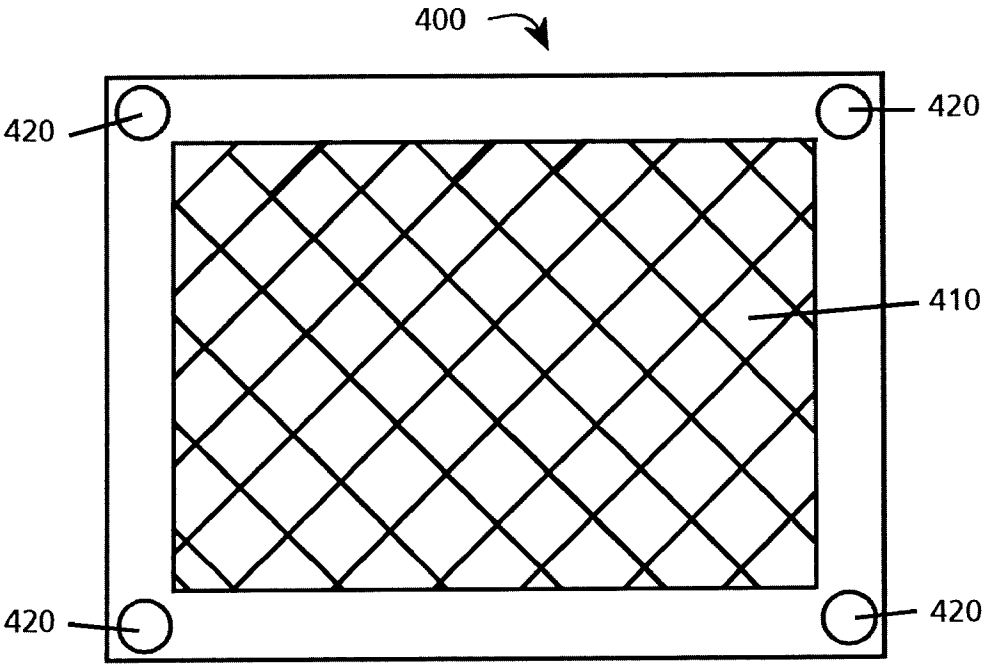
FIG. 9 is a view from above of the floor of a support platform.

Floor 400 is illustrated in FIG. 9. Floor 400 comprises a flat surface 410 in a shape and size adapted to be held in supporting connection with base 210. Extending generally perpendicularly from the perimeter of the surface of floor 400 are side edges which may be externally tangent to base 210, which are illustrated in FIG. 1. At the of surface 410 may include holes 420 of a diameter suitable to permit floor 400 to be placed over scaffolding pins 215 extending upward from base 210. Floor 400 may be made from a material such as 2"×2" angle iron, and may be coated or formed with a non-slip surface to enhance the safety of the support platform 10.

As described in exemplary fashion herein, floor 400 comprises a separate structure from support frame 200. In other embodiments, for convenience floor 400 and support frame 200 may comprise a single inseparable unit.

Figure 5:
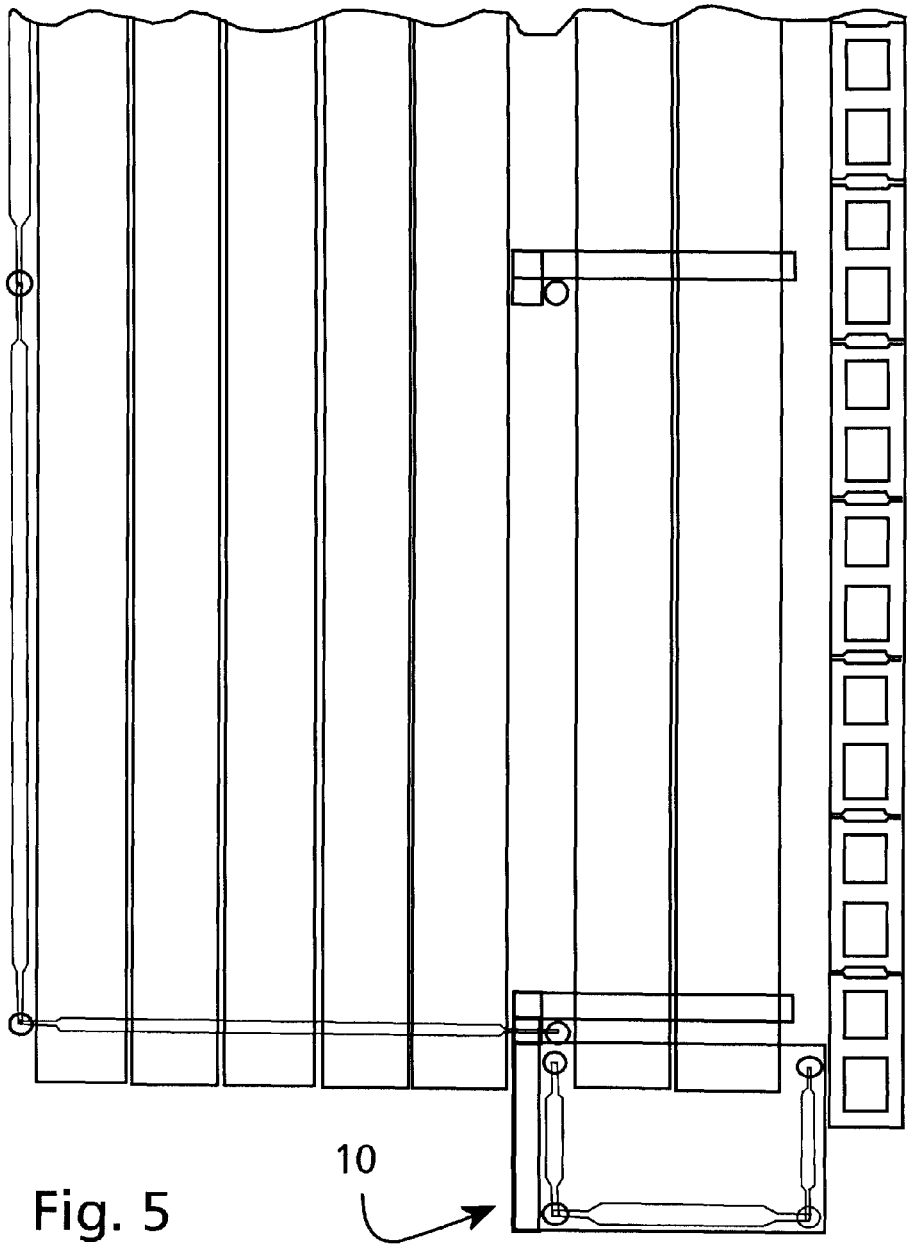
FIG. 5 is view from above a scaffolding on which an exemplary embodiment of a support platform is installed.
Figure 10:
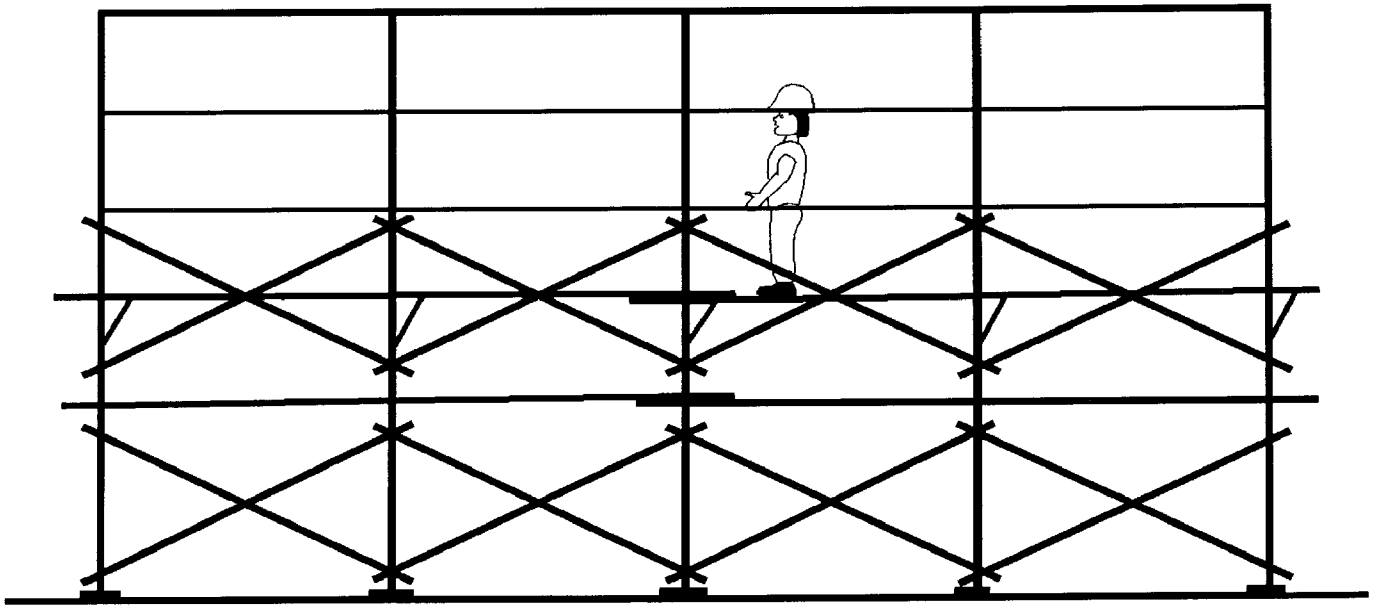
FIGS. 10-19 illustrate raising a scaffolding walkway.

Scaffolding used in construction typically includes a walkway comprised of two rows of wide planks which rest on side brackets extending from the scaffolding frame toward the building. Often, the walkway will be several planks long, with each pair of planks overlapping the next pair of planks in the walkway. This is illustrated in FIGS. 5 and 10.

Figure 11:
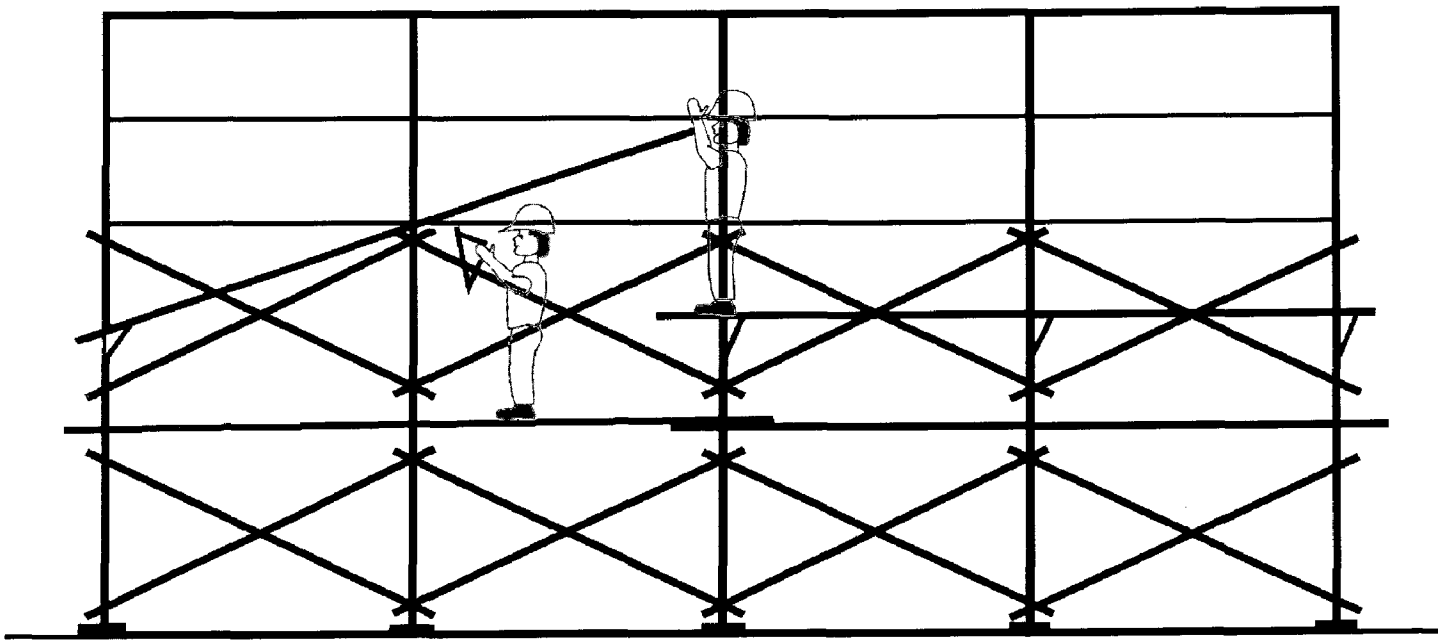
Figure 12:
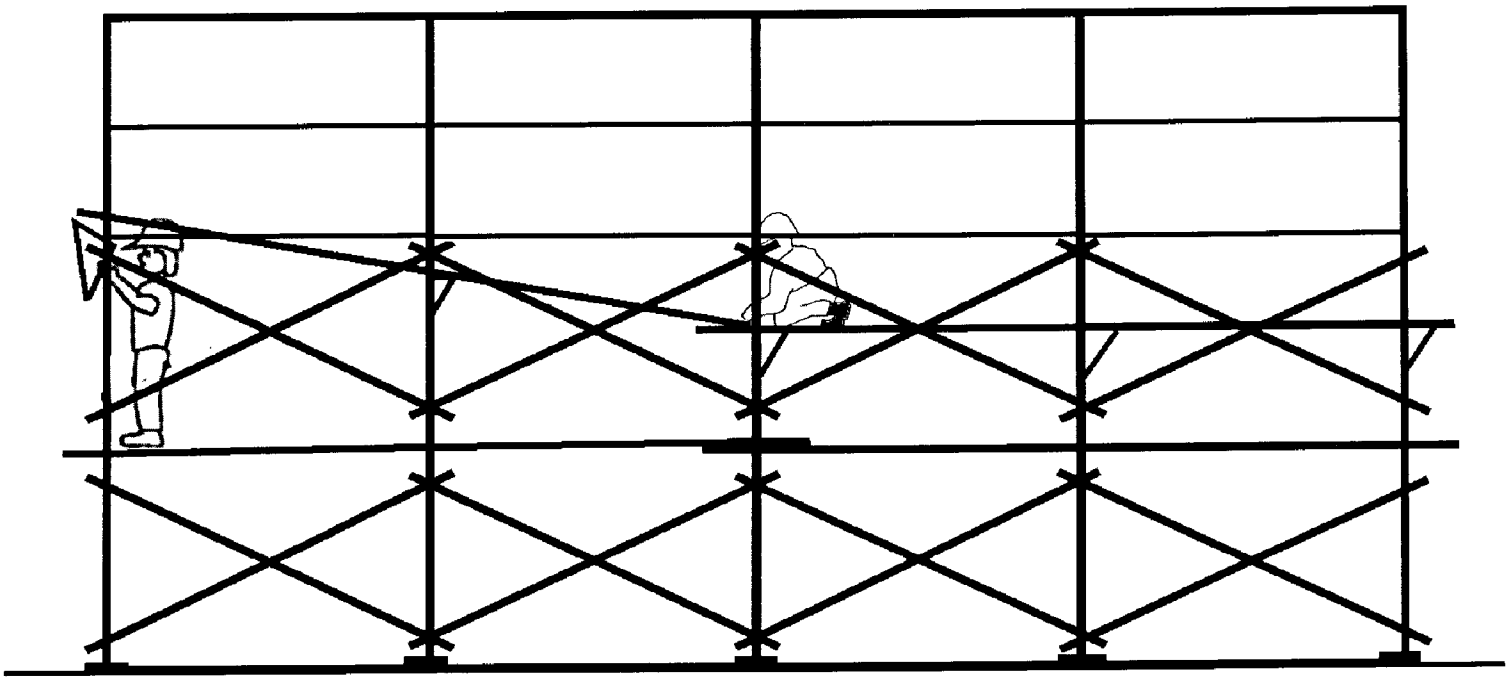
Figure 13:
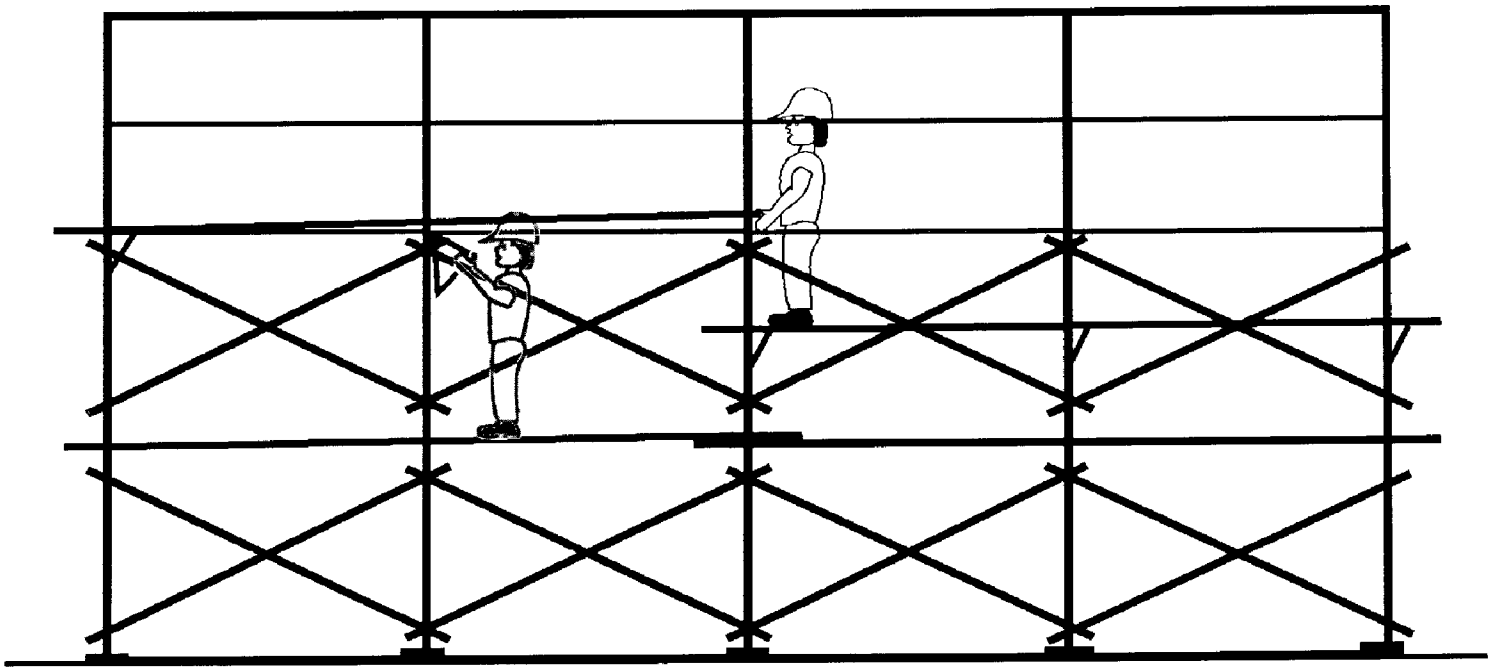

When construction workers complete their work on one level, it is frequently necessary to raise or lower the walkway in order to continue working. This process is illustrated in FIGS. 10 through 15. One worker will stand on the next to last pair of planks in the walkway and lift the overlapping ends of both of the last pair of planks up. A second worker stands on the scaffolding platform and moves the side bracket that previously supported the middle of the pair of planks and move it up or down to approximately half of the desired walkway height, as illustrated in FIG. 11. The first worker then lowers the pair of planks to the newly positioned side bracket, and uses the planks and side bracket as a fulcrum and lever to raise the opposite end of the pair of planks to the desired walkway height, as illustrated in FIG. 12. The second worker moves the side bracket supporting the end of the walkway. The first worker raises the near end of the pair of planks while the second worker raises the middle side bracket to the desired walkway height as illustrated in FIG. 13. The first worker lowers the planks to rest on the end and middle side brackets.

Figure 14:
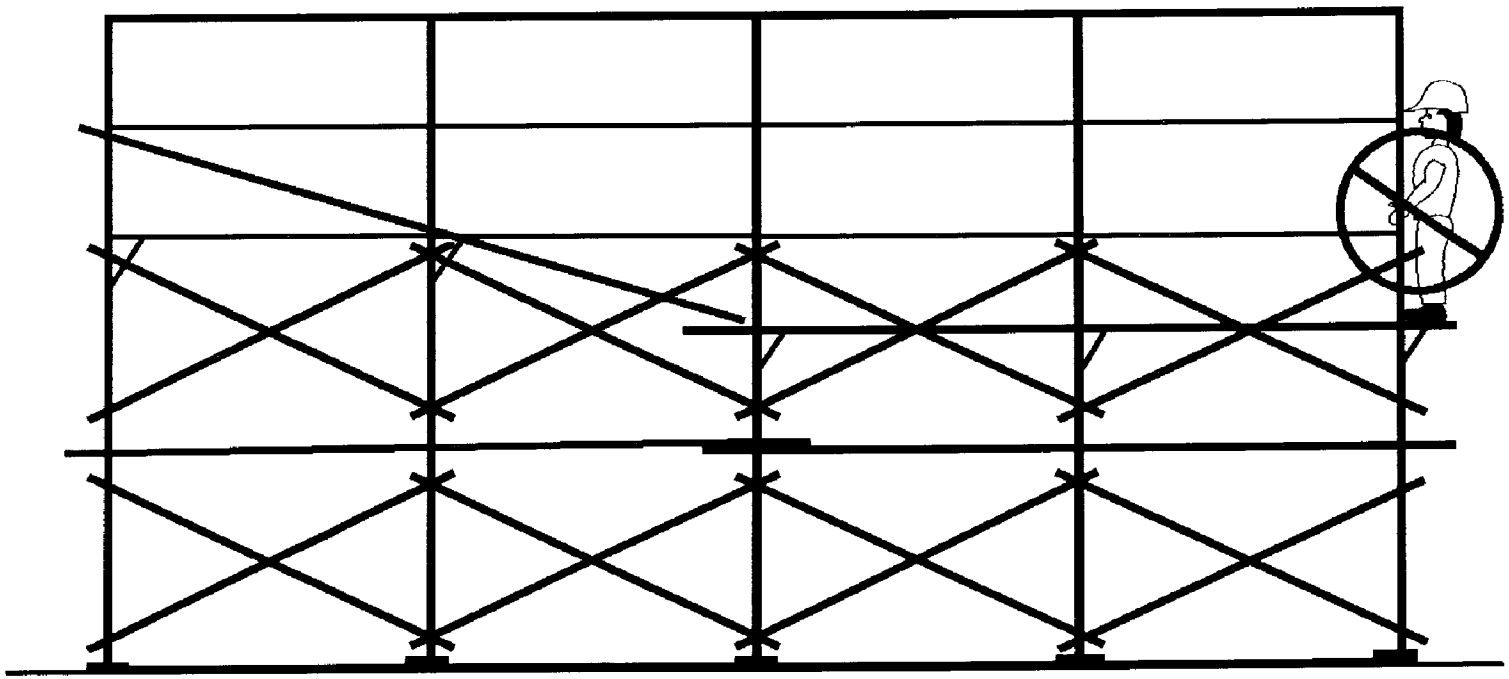
Figure 15:
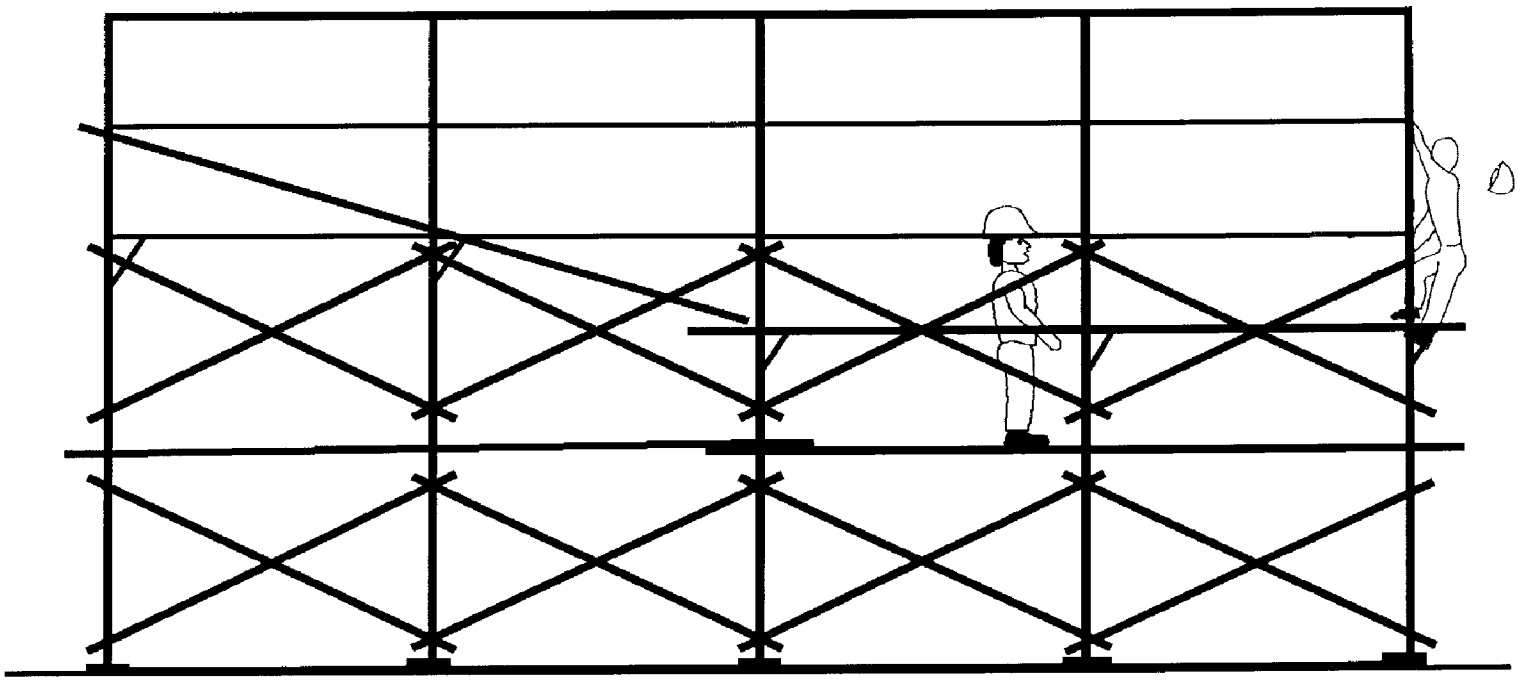
Figure 16:
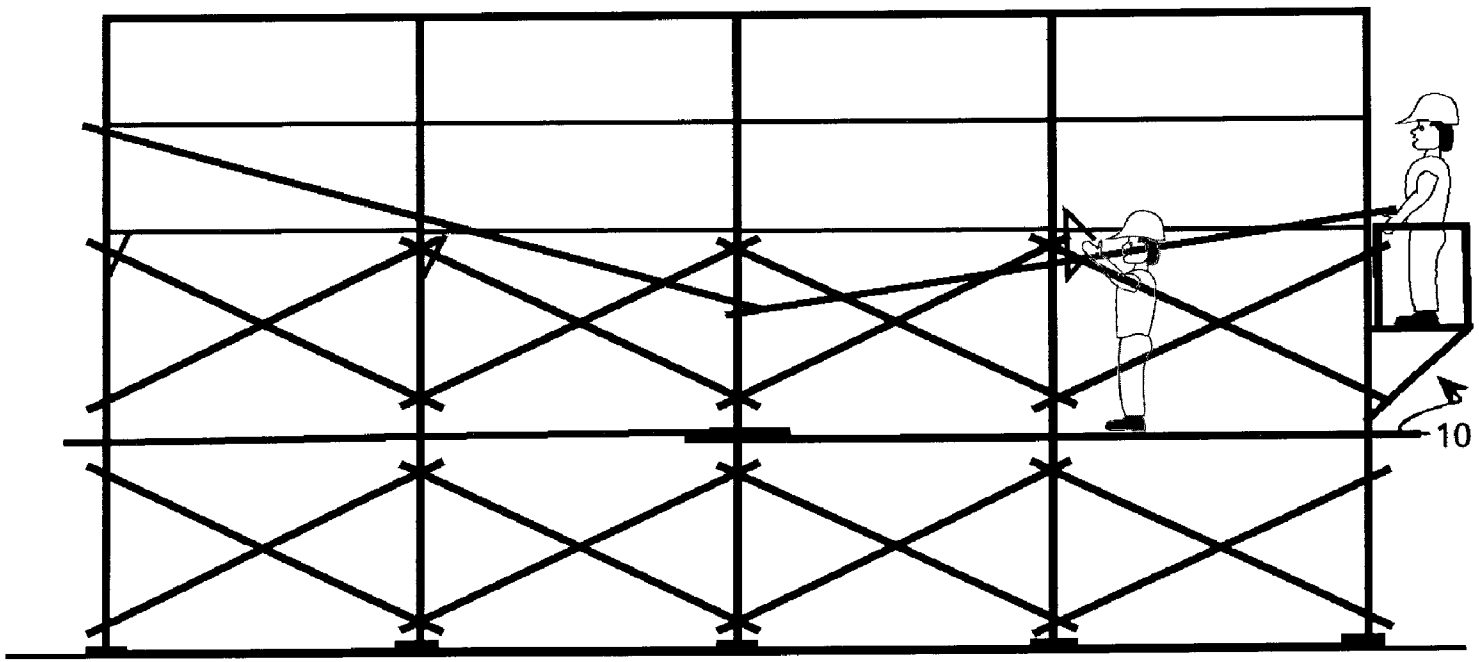
Figure 17:
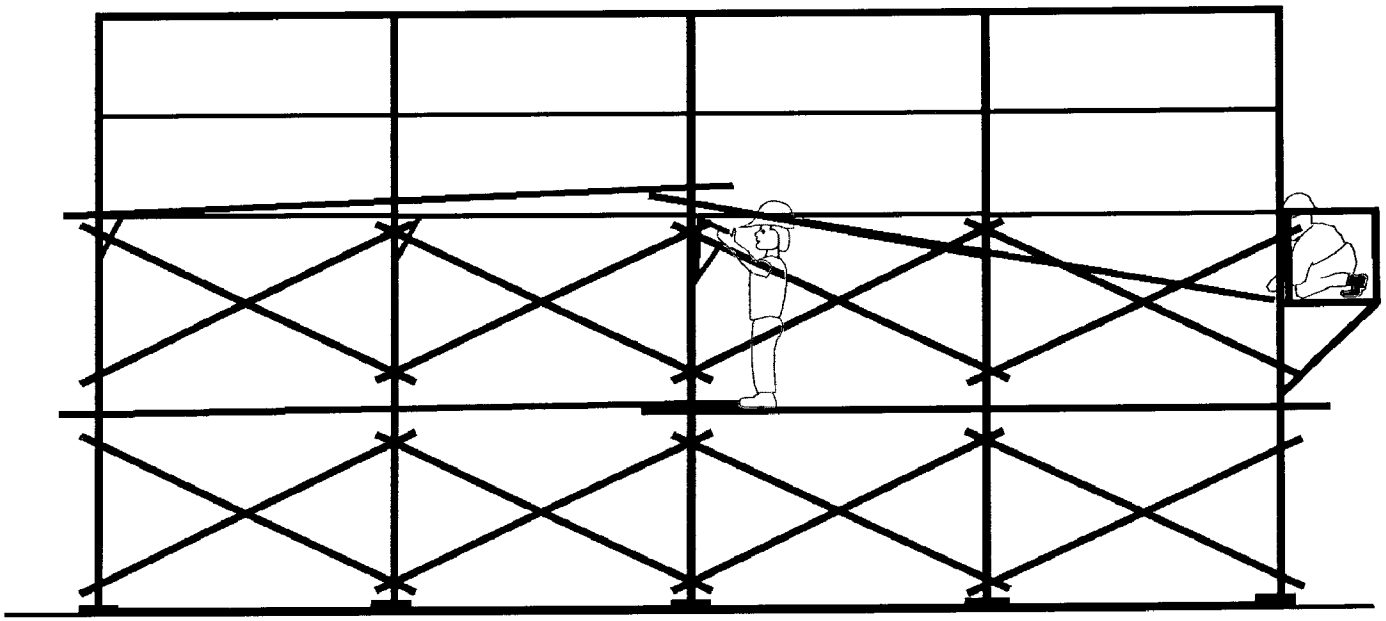
Figure 18:
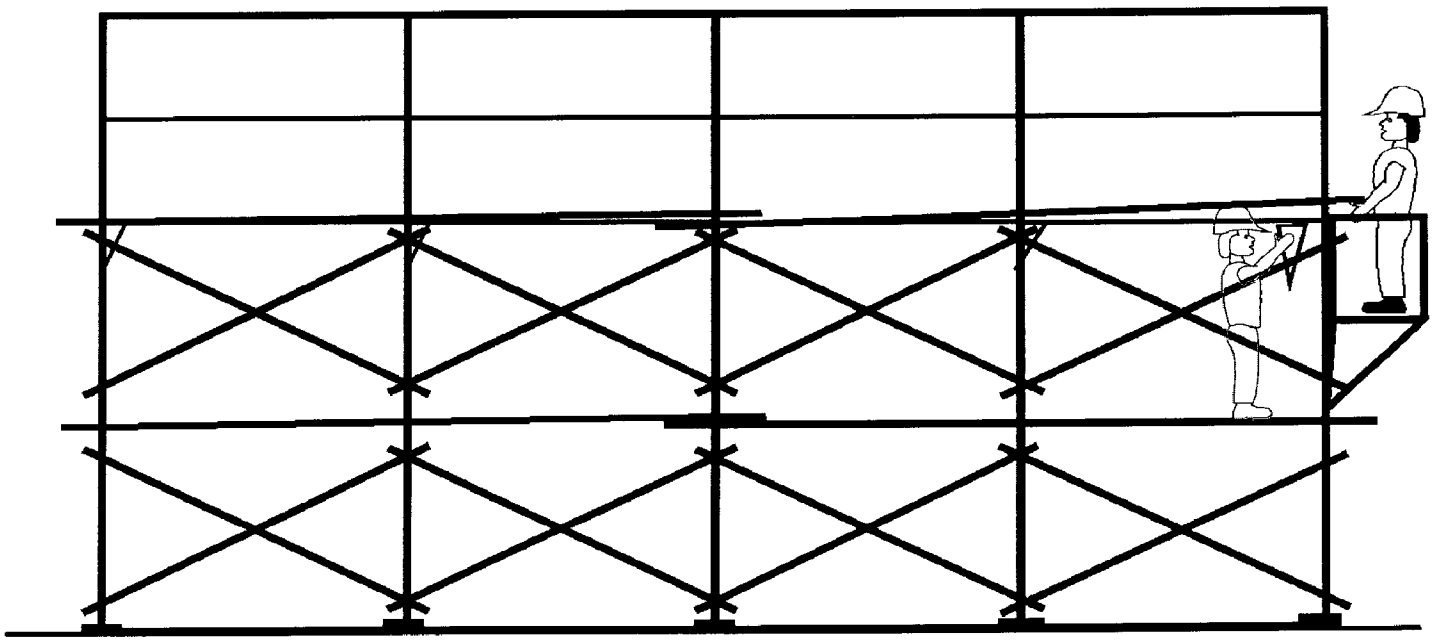
Figure 19:
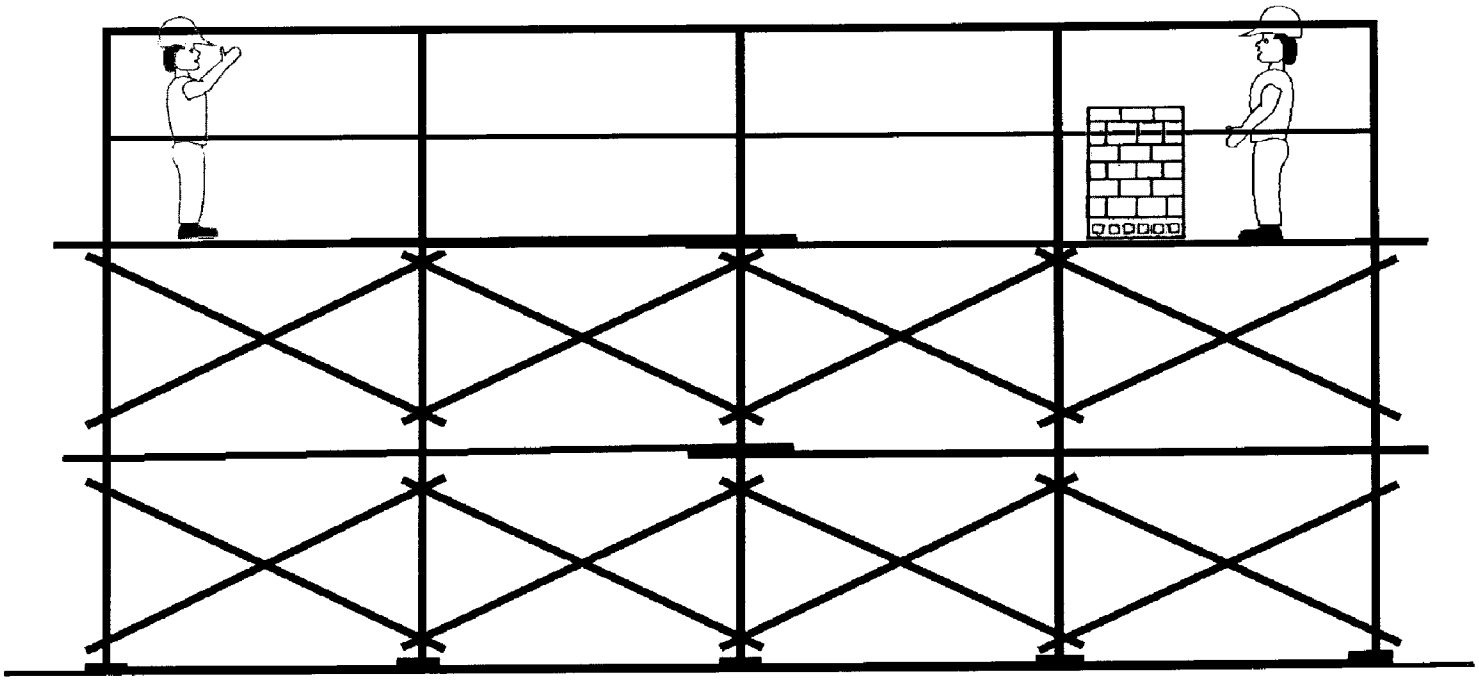
Figure 21:
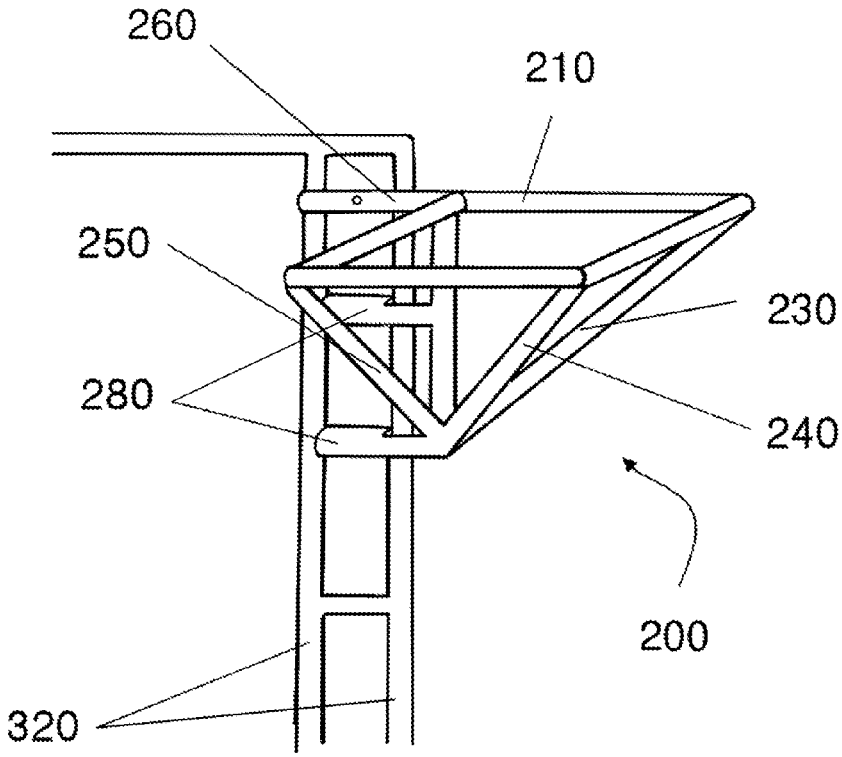
FIG. 21 is a perspective view of an exemplary embodiment of the support frame shown in FIG. 2, having two hook anchors.

This teeter totter method of raising the walkway continues until the workers reach the end of the walkway. As currently practiced, there is no safe means for the workers to raise the last pair of planks, because there is no place for the first worker to stand while the walkway planks are being raised, as is illustrated in FIG. 14. Even though it is prohibited for safety reasons, workers typically cling to the outside of the scaffolding frame, as illustrated in FIG. 15, while attempting to raise the two planks, which often weigh over 100 lbs, above their head while the second worker moves the side brackets. This is an extremely dangerous practice, but one which is currently unavoidable as a practical matter.

The support platform 10, as described in exemplary fashion herein, may be used to eliminate this dangerous practice. A support platform 10 can easily be attached to standard scaffolding frames. When assembling the scaffolding, a second anchor 280 can be slipped over the rung 310 between two vertical tubes 320 in the scaffolding end frame at an appropriate height. Using the walkway for support, one or more first anchors 260 on support platform 10 can be fixed to the scaffolding end frame using clamps 268.

The support frame anchors which comprise hook anchors will need be hooked over rungs 310 simultaneously to permit all such hook anchors to be attached without dislodging the first attached, and generally before attaching anchors comprising clamp or adjusting grasp anchors. The latter will be easier to attach once the weight of the support frame is supported by a hook anchor, and the latter will serve to keep the former from sliding along rungs 310, being inadvertently dislodged, or rotating away from the walkway.

In a support platform in which floor 400 is separate from support frame 200, once the support frame 200 is affixed to the scaffold end frame, floor 400 may be placed in supporting connection over scaffolding pins extending from base 210.

Figure 4:
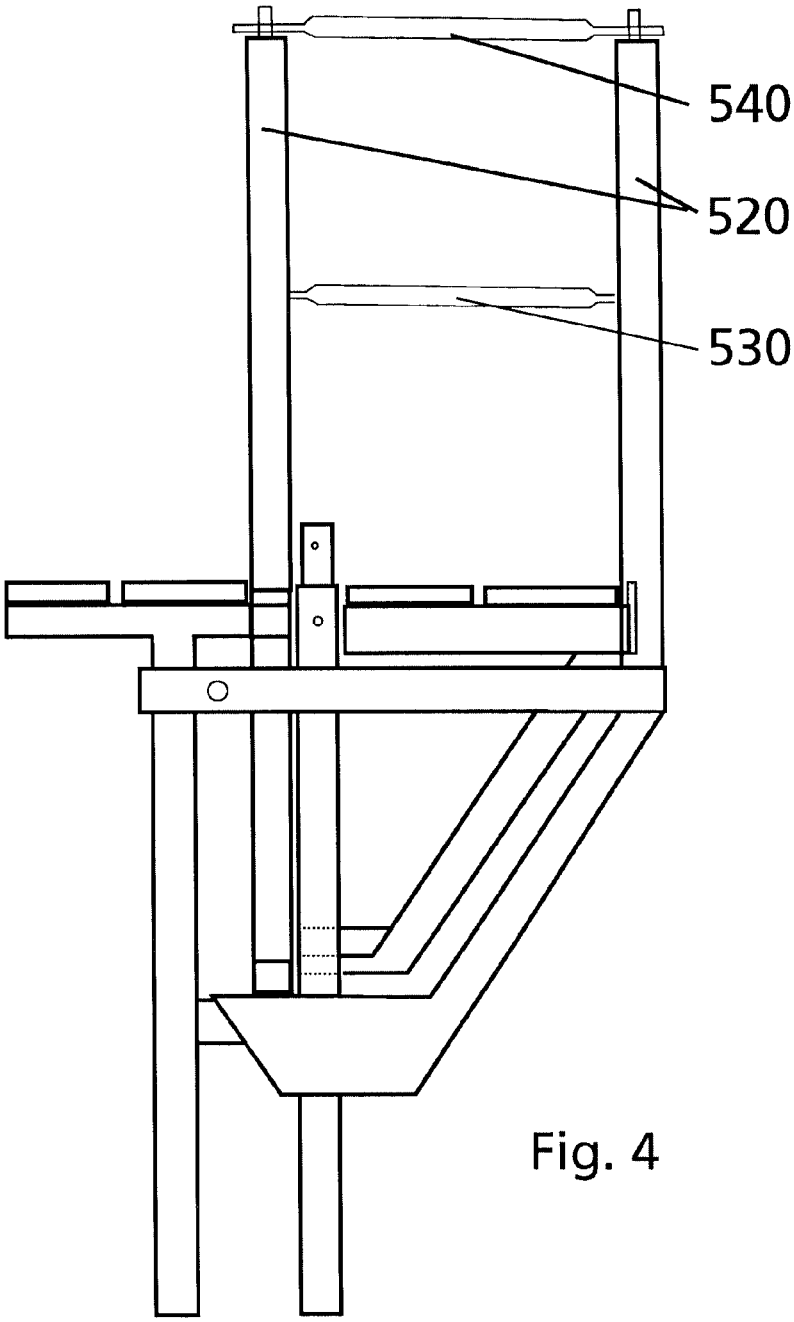
FIG. 4 is a side view of an exemplary embodiment of a support frame for holding up a support platform with installed guard rails, from the perspective of the end of the scaffolding frame.

When the workers are ready to raise the walkway, the support platform 10 provides a safe place for the first worker to stand while raising the last two planks. The safety this provides can be enhanced by the addition of guard rails around the outside portion of perimeter of the support platform. An exemplary embodiment of this support platform with support rails, which include guard rails and midrails, is illustrated in FIGS. 4 and 5, and typical exemplary support rail parts are illustrated in FIG. 20. The support platform may include standard scaffolding pins 510. Once the support platform is placed in position guard rail posts 520 can be affixed using scaffolding pins 510. Guard rails 540 and mid rails 530 can be attached to the guard rail posts 520 using safety or lock pins. Because these parts are standard guard rail scaffolding parts, standard guard rails can be erected around the support platform by the same means they are affixed to the rest of the scaffold. Because standard guard rails can be used, the guard rail around the entire scaffolding assembly can be nearly continuous, providing a significant safety advantage.

Although in the exemplary embodiment illustrated the support rails are formed from individual components, commercially available integrated rails which include an assembled guard rail, mid rail, and toe guard may also be installed in a suitable length. In other exemplary embodiments other forms of commercially available safety equipment may be used, as the exemplary embodiment illustrated in several figures herein contain or are adapted to accept standard scaffolding connectors.

Once the walkway is raised or lowered to the desired level, the walkway can be used as a base from which the support platform 10 can be raised or lowered so that the surface of the support platform is level with the walkway. In an exemplary embodiment using a single anchor 260, the worker will release the clamp anchor and lift the hook anchor 280 of the support platform 10 off of the rung 310 on which anchor 280 is resting. The worker will then raise it or lower it so that it is approximately level with the new walkway, rest anchor 280 over the closest rung, and clamp anchor 260 to the scaffolding end frame.

The scaffolding system described herein is intended to be illustrative of scaffolding with which the support platform is intended to be used, rather than limiting. The support platform described herein may be modified without undue experimentation for use with other systems which include one or more vertical uprights and or rungs to which the anchors of the support platform may be attached.

In the foregoing description certain terms have been used for brevity, clarity, and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function and shall not be limited to the structures shown herein or mere equivalents thereof.

Having described the features, discoveries and the principles of the invention, the manner in which it is constructed and operated and the advantages and useful results attained; the new and useful structures, devices elements, arrangements, parts, combinations, systems, equipment, operations, methods and relationships are set forth in the appended claims.

I claim:

1. An apparatus comprising a scaffolding support platform for use with scaffolding system including a fabricated end frame further comprising:

a floor wherein the floor comprises a flat surface adapted to support a worker a support frame including a rectangular base adapted to support the floor having first through fourth corners, a plurality of support members each having first and second ends, wherein the first ends of a first vertical support member and at least three diagonal support members are adjacent respectively the first through fourth corners of the base, and extend between said respective corners and the second end of the first support member, and a plurality of anchors, including first and second anchors, adapted to releasably attach the support frame to a fabricated end frame, wherein the first anchor comprises a horizontal extension from the base in the same plane as the second anchor and wherein the first anchor is characterized by a first side which is opposed to the base and wherein the first side further includes detents adapted to conform to vertical support members of a fabricated end frame and where the first anchor is further adapted to cooperate with a double "C" clamp to releasably affix the first anchor to the fabricated end frame, and the second anchor is spaced apart from the base and comprises a horizontal extension from the second end of the first support member, which extension lies in a plane defined by the first and second support members, and wherein the anchor further comprises a plate hook extending from the horizontal extension which is adapted to rest on a rung of a scaffolding end frame.

2. The apparatus of claim 1 wherein the first through fourth corners of the support frame further include scaffolding pins.

3. The apparatus of claim 2 further comprising a guard rail including guard rail posts releasably attached to the scaffolding pins, and guard rails releasably attached to the guard rail posts.

4. The apparatus of claim 3 further wherein the guard rail further includes mid rails releasably attached to the guard rail posts.

5. The apparatus of claim 1 further including a third anchor affixed to the first support member wherein the third anchor comprises a hook anchor.

* * * * *